US008025556B2

(12) United States Patent
Kajiyama et al.

(10) Patent No.: US 8,025,556 B2
(45) Date of Patent: Sep. 27, 2011

(54) METHOD OF GRINDING WAFER

(75) Inventors: Keiichi Kajiyama, Ota-Ku (JP); Takatoshi Masuda, Ota-ku (JP); Shinya Watanabe, Ota-ku (JP); Setsuo Yamamoto, Ota-Ku (JP)

(73) Assignee: Disco Corporation, Tokyo (JP)

( * ) Notice: Subject to any disclaimer, the term of this patent is extended or adjusted under 35 U.S.C. 154(b) by 506 days.

(21) Appl. No.: 12/349,770

(22) Filed: Jan. 7, 2009

(65) Prior Publication Data

US 2009/0186562 A1 Jul. 23, 2009

(30) Foreign Application Priority Data

Jan. 23, 2008 (JP) ..... 2008-012195

(51) Int. Cl.
*B24B 1/00* (2006.01)

(52) U.S. Cl. ..... 451/57; 451/54; 451/65; 451/66; 451/41

(58) Field of Classification Search ..... 451/57, 451/54, 65, 66, 41, 26, 269, 260, 63
See application file for complete search history.

(56) References Cited

U.S. PATENT DOCUMENTS

| | | | | |
|---|---|---|---|---|
| 5,122,481 | A * | 6/1992 | Nishiguchi | 438/510 |
| 6,059,637 | A * | 5/2000 | Pasch et al. | 451/41 |
| 6,241,581 | B1 * | 6/2001 | Miyashita et al. | 451/41 |
| 6,676,491 | B2 * | 1/2004 | Arai et al. | 451/57 |
| 6,749,487 | B2 * | 6/2004 | Okuhata et al. | 451/41 |
| 6,957,511 | B1 * | 10/2005 | Leigh et al. | 451/36 |
| 7,507,146 | B2 * | 3/2009 | Kato et al. | 451/41 |
| 2001/0055941 | A1 * | 12/2001 | Koos et al. | 451/57 |
| 2002/0155795 | A1 * | 10/2002 | Ferra et al. | 451/57 |
| 2003/0129929 | A1 * | 7/2003 | Monaka et al. | 451/55 |
| 2004/0005845 | A1 * | 1/2004 | Kitajima et al. | 451/57 |
| 2008/0057837 | A1 * | 3/2008 | Shiratani et al. | 451/57 |
| 2009/0163120 | A1 * | 6/2009 | Kanazawa | 451/54 |
| 2009/0247050 | A1 * | 10/2009 | Arisa et al. | 451/5 |

FOREIGN PATENT DOCUMENTS

JP A 2001-1261 1/2001

* cited by examiner

*Primary Examiner* — George Nguyen
(74) *Attorney, Agent, or Firm* — Greer, Burns & Crain, Ltd.

(57) ABSTRACT

A method of grinding a wafer, including: a wafer holding step for holding a wafer on a conical holding surface of a chuck table having the holding surface; a rough grinding step for performing rough grinding of the wafer held on the holding surface of the chuck table by positioning a grinding surface of a rough grinding wheel at a predetermined inclination angle relative to the holding surface of said chuck table, and rotating the rough grinding wheel; and a finish grinding step for performing finish grinding of the wafer by positioning a grinding surface of a finish grinding wheel in parallel to the holding surface of the chuck table, and rotating the finish grinding wheel in a grinding region of the grinding wheel in a direction toward the vertex of the contact angle between the grinding surface of the finish grinding wheel and the surface to be ground of the wafer.

4 Claims, 10 Drawing Sheets

METHOD OF GRINDING WAFER

BACKGROUND OF THE INVENTION

1. Field of the Invention

The present invention relates to a method of grinding a wafer by which the back-side surface of a wafer such as a semiconductor wafer is ground.

2. Description of the Related Art

In the semiconductor device manufacturing process, a semiconductor wafer provided with a plurality of circuits such as ICs and LSIs is made to have a predetermined thickness by grinding the back-side surface thereof using a grinding apparatus, before being divided into individual chips. The grinding apparatus includes a chuck table for holding the wafer, and a grinding means for grinding the wafer held on the chuck table. In order to grind the back-side surface of the wafer efficiently, a grinding apparatus is generally used which includes a rough grinding means having a rough grinding wheel and a finish grinding means having a finish grinding wheel (refer to, for example, Japanese Patent Laid-open No. 2001-1261).

In grinding a wafer by use of the just-mentioned grinding apparatus having a rough grinding means and a finish grinding means, the wafer held on the chuck table is subjected to rough grinding by the rough grinding means so as to leave a finishing margin, and the wafer having thus undergone the rough grinding is subjected to finish grinding by the finish grinding means so as to obtain a predetermined thickness.

When the wafer ground by the rough grinding means is ground by the finish grinding means, the minute grain diameter of the abrasive grains of the finish grinding stone constituting the finish grinding wheel of the finish grinding means may result in that the so-called bite into the wafer is weak so that surface burning occurs. Besides, the pressing force may be increased attendant on the grinding feed, leading to lowered quality of the wafer.

SUMMARY OF THE INVENTION

Accordingly, it is an object of the present invention is to provide a method of grinding a wafer by which the so-called bite into a wafer can be improved and the surface burning can be obviated, in a process wherein a wafer having been ground by rough grinding means is ground by a finish grinding means.

In accordance with a first aspect of the present invention, there is provided a method of grinding a wafer, including: a wafer holding step for holding a wafer on a conical holding surface of a chuck table having the holding surface; a rough grinding step for performing rough grinding of the wafer held on the holding surface of the chuck table, by positioning a grinding surface of a rough grinding wheel at a predetermined inclination angle relative to the holding surface of the chuck table and rotating the grinding wheel; and a finish grinding step for performing finish grinding of the wafer by positioning a grinding surface of a finish grinding wheel in parallel to the holding surface of the chuck table, and rotating the finish grinding wheel in a grinding region of the grinding wheel in a direction toward the vertex of a contact angle between the grinding surface of the finish grinding wheel and a surface to be ground of the wafer.

Preferably, the inclination angle of the grinding surface of the rough grinding wheel relative to the holding surface of the chuck table is set in the range of 0.01 to 0.03 milliradian.

In accordance with a second aspect of the present invention, there is provided a method of grinding a wafer, including: a wafer holding step for holding a wafer on a conical holding surface of a chuck table having the holding surface; a rough grinding step for performing rough grinding of the wafer held on the holding surface of the chuck table, by positioning a grinding surface of a rough grinding wheel in parallel to the holding surface of the chuck table and rotating the rough grinding wheel; and a finish grinding step for performing finish grinding of the wafer by positioning a grinding surface of a finish grinding wheel at a predetermined inclination angle relative to the holding surface of the chuck table, and rotating the finish grinding wheel in a grinding region of the grinding wheel in a direction toward a vertex of a contact angle between the grinding surface of the finish grinding wheel and a surface to be ground of the wafer.

Preferably, the inclination angle of the grinding surface of the finish grinding wheel relative to the holding surface of the chuck table is set in the range of 0.01 to 0.03 milliradian.

According to the first aspect of the method of grinding a wafer of the present invention, the rough grinding step is carried out in the condition where the grinding surface of the rough grinding wheel is positioned at a predetermined inclination angle relative to the holding surface of the chuck table, and the finish grinding step is carried out in the condition where the grinding surface of the finish grinding wheel is positioned in parallel to the holding surface of the chuck table and where the finish grinding wheel is rotated in the grinding region of the finish grinding wheel in the direction toward the vertex of the contact angle between the grinding surface of the finish grinding wheel and the surface to be ground of the wafer. Therefore, even when the grain diameter of the abrasive grains of the finish grinding stone constituting the finish grinding wheel is minute, the so-called bite into the wafer is made to be good, and surface burning can be prevented from occurring.

According to the second aspect of the method of grinding a wafer of the present invention, the rough grinding step is carried out in the condition where the grinding surface of the rough grinding wheel is positioned in parallel to the holding surface of the chuck table, and the finish grinding step is carried out in the condition where the grinding surface of the finish grinding wheel is positioned at a predetermined inclination angle relative to the holding surface of the chuck table and where the finish grinding wheel is rotated in the grinding region of the finish grinding wheel in the direction toward the vertex of the contact angle between the grinding surface of the finish grinding wheel and the surface to be ground of the wafer. Therefore, even when the grain diameter of the abrasive grains of the finish grinding stone constituting the finish grinding wheel is minute, the so-called bite into the wafer is made to be good, and surface burning can be prevented from occurring.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
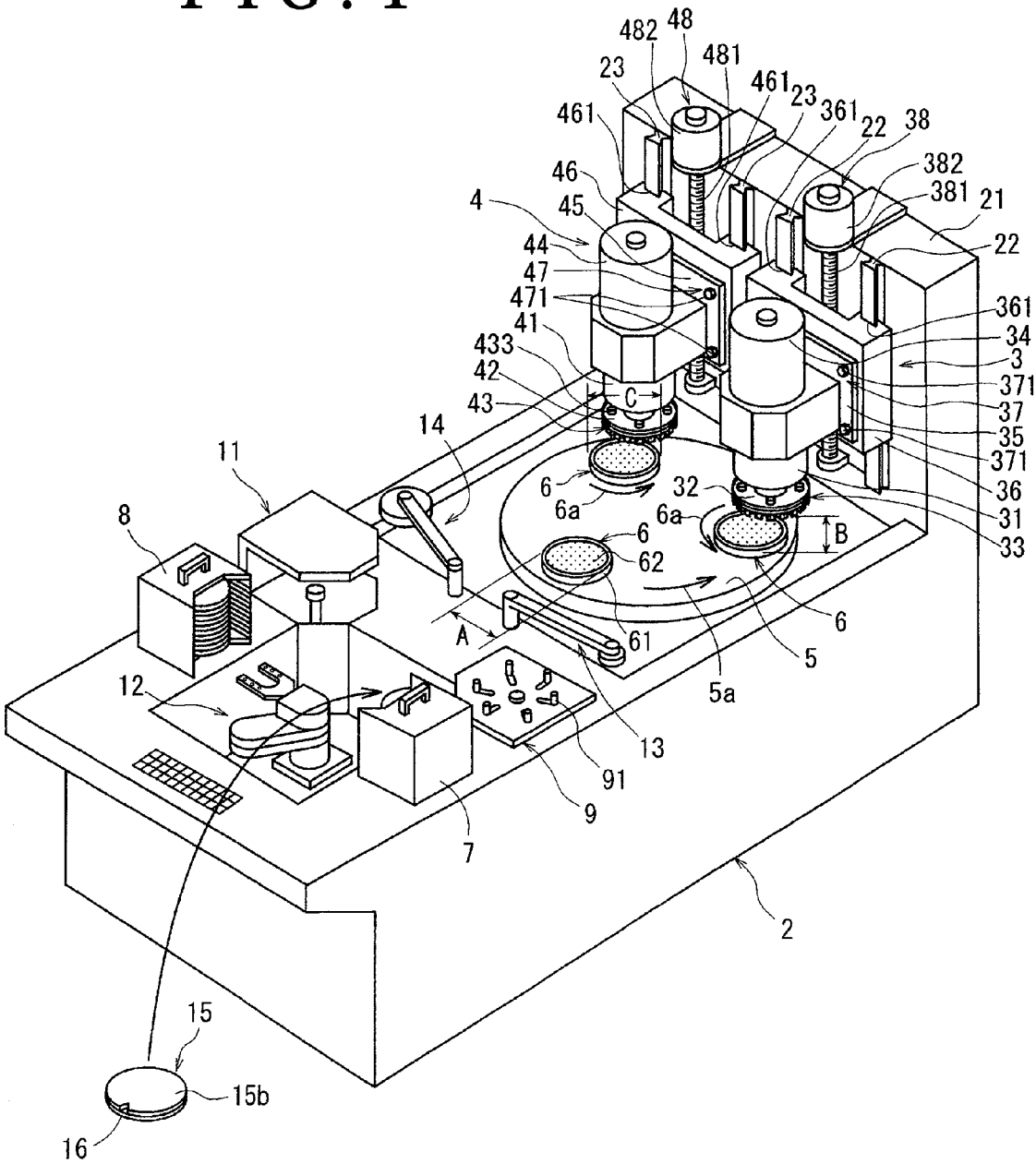
FIG. 1 is a perspective view of a grinding apparatus for carrying out the method of grinding a wafer according to the present invention.

Now, some preferred embodiments of the method of grinding a wafer according to the present invention will be described more in detail below, referring to the attached drawings. FIG. 1 shows a perspective view of a grinding apparatus for carrying out the method of grinding a wafer according to the invention. The grinding apparatus in the embodiment shown in the figure has an apparatus housing 2 which is roughly rectangular parallelepipedic in shape. At the right upper end, in FIG. 1, of the apparatus housing 2, a stationary support plate 21 is erectly provided. On a front side surface of the stationary support plate 21, two pairs of guide rails 22, 22 and 23, 23 extending in the vertical direction are provided. A rough grinding unit 3 as a rough grinding unit is vertically movably mounted to the guide rails 22, 22 on one side, and a finish grinding unit 4 as a finish grinding means is vertically movably mounted to the guide rails 23, 23 on the other side.

The rough grinding unit 3 includes: a unit housing 31; a rough grinding wheel 33 attached to a wheel mount 32 rotatably mounted to the lower end of the unit housing 31; an electric motor 34 which is mounted to the upper end of the unit housing 31 and which can be driven to perform normal rotation and reverse rotation for driving the wheel mount 32 to rotate; a support member 35 for supporting the unit housing 31; a movable base 36 to which the support member 35 is attached; and an angle adjusting means 37 having a plurality of adjusting bolts 371 for attaching the support member 35 to the movable base 36 so as to enable an angle adjustment.

Figure 2:
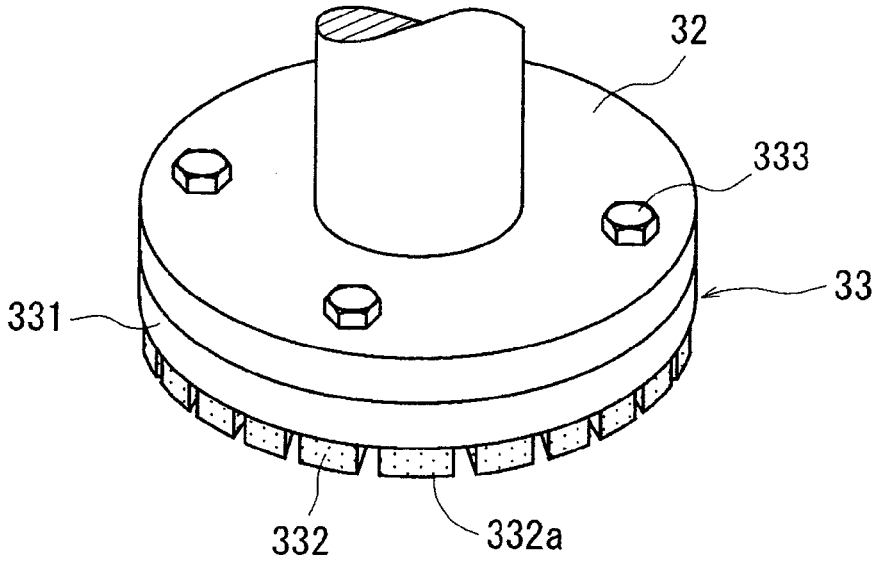
FIG. 2 is a perspective view of a grinding wheel constituting a rough grinding unit provided in the grinding apparatus shown in FIG. 1.

The rough grinding wheel 33, as shown in FIG. 2, includes a grinding stone base 331, and a plurality of rough grinding stones 332 attached to the lower surface of the grinding stone base 33 in an annular overall pattern. The grinding stone base 331 is attached to the wheel mount 32 by fastening bolts 333. The rough grinding stone 332 is formed by binding, for example, diamond abrasive grains having a grain diameter of about 10 μm by use of a resin bond, and its lower surface constitutes a grinding surface 332*a*.

Continuing description by returning to FIG. 1, the movable base 36 is provided with guided rails 361, 361, and the guided rails 361, 361 are movably engaged with the guide rails 22, 22 provided on the stationary support plate 21, whereby the rough grinding unit 3 is supported in a vertically movable manner. The rough grinding unit 3 in the embodiment shown in the figure, a grinding feeding mechanism 38 for putting the grinding wheel 33 into grinding feed by moving the movable base 35 along the guide rails 22, 22. The grinding feeding mechanism 38 includes: a male screw rod 381 which is vertically arranged on the stationary support plate 21 in parallel to the guide rails 22, 22 and which is rotatably supported; a pulse motor 382 for driving the male screw rod 381 to rotate; and a female screw block (not shown) which is mounted to the movable base 36 and which is put in screw engagement with the male screw rod 381. With the male screw rod 381 driven to rotate normally and reversely by the pulse motor 382, the rough grinding unit 3 is moved in the vertical direction. The angle adjusting means 37 has a configuration in which the plurality of adjusting bolts 371 are passed through slots (not shown) provided in the support member 35 and are put in screw engagement with female screw holes formed in the movable base 36, and the attachment angle of the unit housing 31 is adjusted by regulating the fastening positions at the slots provided in the support member 35.

The finish grinding unit 4, configured similarly to the rough grinding unit 3, includes: a unit housing 41; a finish grinding wheel 43 attached to a wheel mount 42 rotatably mounted to the lower end of the unit housing 41; an electric motor 44 which is mounted to the upper end of the unit housing 41 and which can be driven to perform normal rotation and reverse rotation for driving the wheel mount 42 to rotate; a support member 45 for supporting the unit housing 41; a movable base 46 to which the support member 45 is attached; and an angle adjusting means 47 having a plurality of adjusting bolts 471 for attaching the support member 45 to the movable base 46 so as to enable an angle adjustment.

Figure 3:
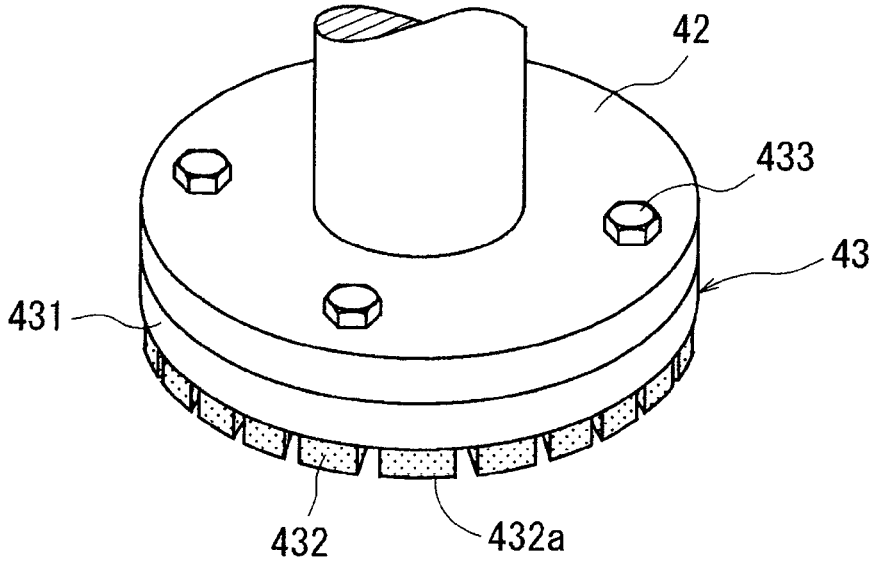
FIG. 3 is a perspective view of a grinding wheel constituting a finish grinding unit provided in the grinding apparatus shown in FIG. 1.

The finish grinding wheel 43, as shown in FIG. 3, includes a grinding stone base 431, and a plurality of finish grinding stones 432 mounted to the lower surface of the grinding stone base 431 in an annular overall pattern. The grinding stone base 431 is attached to a wheel mount 42 by fastening bolts 433. The finish grinding stone 432 is formed, for example, by binding diamond abrasive grains having a grain diameter of about 1 μm by use of a vitrified bond, and its lower surface constitutes a grinding surface 432*a*.

Continuing description by returning to FIG. 1, the movable base 46 is provided with guided rails 461, 461, and the guided rails 461, 461 are put in slidable engagement with guide rails 23, 23 provided on the stationary support plate 21, whereby the finish grinding unit 4 can be supported movably in the vertical direction. The finish grinding unit 4 in the embodiment shown in the figure has a grinding feeding mechanism 48 which puts the grinding wheel 43 into grinding feed by moving the movable base 46 along the guide rails 23, 23. The finish grinding mechanism 48 includes: a male screw rod 481 which is vertically disposed on the stationary support plate 21 in parallel to the guide rails 23, 23 and which is rotatably supported; a pulse motor 482 for driving the male screw rod 481 to rotate; and a female screw block (not shown) attached to the movable base 46 and put in screw engagement with the male screw rod 481. With the male screw rod 481 driven to rotate normally and reversely by the pulse motor 482, the finish grinding unit 4 is moved in the vertical direction. The angle adjusting means 47 has a configuration in which a plurality of adjusting bolts 471 are passed through slots provided in the support member 45 and are screw engaged with female screw holes formed in the movable base 46. The attachment angle of the unit housing 41 is adjusted by regulating the fastening positions of the slots provided in the support member 45.

The grinding apparatus in the embodiment shown in the figures has a turntable 5 disposed on the front side of the stationary support plate 21 so as to be substantially flush with the upper surface of the apparatus housing 2. The turntable 5 is formed in a circular disk-like shape with a comparatively large diameter, and is rotated, as required, in the direction of arrow 5*a* by a rotation driving mechanism (not shown). In the case of the embodiment shown in the figure, the turntable 5 is provided with three chuck tables 6 which are arranged at phase angles of 120 degrees and which can be rotated in a horizontal plane. The chuck table 6 will be described below, referring to FIG. 4.

Figure 4:
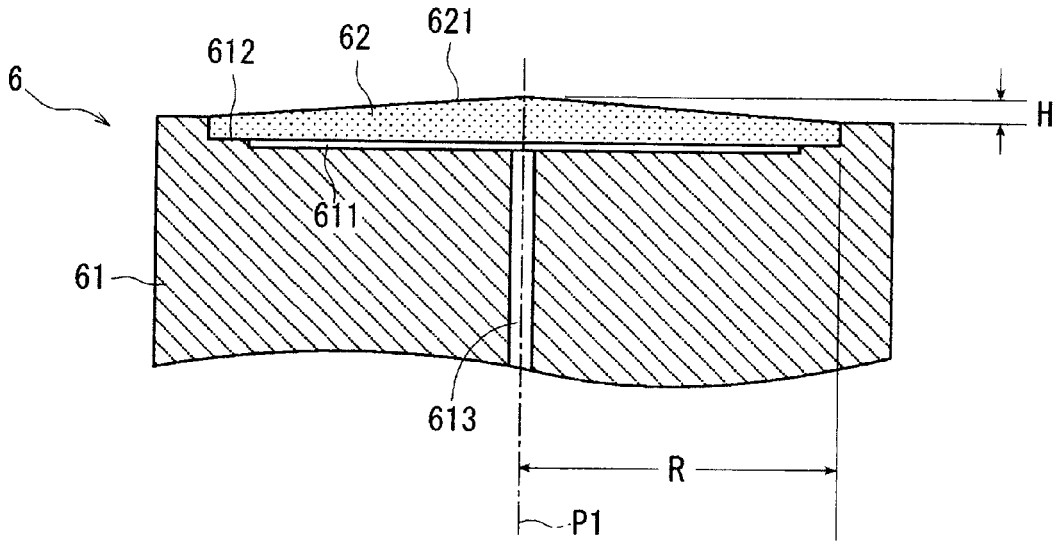
FIG. 4 is a sectional view showing, in an enlarged form, an essential part of a chuck table provided in the grinding apparatus shown in FIG. 1.

The chuck table 6 shown in FIG. 4 has a circular chuck table body 61, and a circular suction holding chuck 62 arranged on the upper surface of the chuck table body 61. The chuck table body 61 is formed of a metallic material such as stainless steel, is provided with a circular fitting recess 611 in the upper surface thereof, and is provided with an annular mount shelf 612 at a peripheral part of the bottom surface of the fitting recess 611. A suction holding chuck 62 composed of a porous member formed from a porous ceramic or the like having innumerable suction pores is fitted in the fitting recess 611. The suction holding chuck 62 fitted in the fitting recess 611 of the chuck table body 61 has a structure in which a holding surface 621 as the upper surface thereof is formed in a conical shape with an apex on the rotational center P1, as exaggeratedly shown in FIG. 4.

The holding surface 621 formed in the conical shape has a gradient (H/R) of 0.00001 to 0.001, where R is the radius of the holding surface 621, and H is the height of the apex of the holding surface 621. In addition, the chuck table body 61 is provided with a communicating passage 613 communicating with the fitting recess 611, and the communicating passage 613 is in communication with a suction means (not shown). Therefore, when a wafer as a work is mounted on the holding surface 621 consisting of the upper surface of the suction holding chuck 62 and the suction means (not shown) is operated, the wafer is suction held on the holding surface 621. The chuck table 6 thus configured is rotated in the direction of arrow 6a by the rotation driving mechanism (not shown) as shown in FIG. 1. The three chuck tables 6 arranged on the turntable 5 are sequentially moved into a work feeding-in/feeding-out region A, a rough grinding region B, and a finish grinding region C and back to the work feeding-in/feeding-out region A, by rotating the turntable 5, as required.

The grinding apparatus shown in the figure includes: a first cassette 7 which is arranged on one side of the work feeding-in/feeding-out region A and in which semiconductor wafers as works yet to be ground are stocked; a second cassette 8 which is arranged on the other side of the work feeding-in/feeding-out region A and in which semiconductor wafers as works having been ground are stocked; a centering means 9 which is arranged between the first cassette 7 and the work feeding-in/feeding-out region A and by which the work is centered; a spinner cleaning means 11 arranged between the work feeding-in/feeding-out region A and the second cassette 8; a work feeding means 12 by which the semiconductor wafer as a work stocked in the first cassette 7 is fed out to the centering means 9 and by which the semiconductor wafer cleaned by the spinner cleaning means 11 is fed into the second cassette 8; a work feeding-in means 13 by which the semiconductor wafer mounted on the centering means 9 and centered is fed onto the chuck table 6 positioned in the work feeding-in/feeding-out region A; and a work feeding-out means 14 by which the ground semiconductor wafer mounted on the chuck table 6 positioned in the work feeding-in/feeding-out region A is fed to the cleaning means 11. Incidentally, in the first cassette 7, a plurality of semiconductor wafers 15 are contained with protective tapes 16 adhered to the face-side surfaces thereof. In this instance, the semiconductor wafer 15 are each contained with the back-side surface 15*b* thereof on the upper side.

The grinding apparatus in the embodiment shown in the figures is configured as above, and is operated as described below. The semiconductor wafer 15 as the work to be ground which is contained in the first cassette 7 is fed by up/down motions and advancing/retreating operations of the work feeding means 12, is mounted onto the centering means 9, and is centered by centripetal radial motions of six pins 91. The semiconductor wafer 15 mounted on the centering means 9 and centered is mounted onto the suction holding chuck 62 of the chuck table 6 which is positioned in the work feeding-in/feeding-out region A, by a slewing operation of the work feeding-in/feeding-out means 14. Then, the suction means (not shown) is operated so as to hold the semiconductor wafer 15 onto the suction holding chuck 62 by suction. Next, the turntable 5 is rotated by 120 degrees in the direction of arrow 5*a* by the rotation driving mechanism (not shown) so that the chuck table 6 with the semiconductor wafer mounted thereon is positioned into the rough grinding region B.

After the chuck table 6 with the semiconductor wafer 15 held thereon is positioned in the rough grinding region B, the chuck table 6 is rotated in the direction of arrow 6*a* by the rotation driving mechanism (not shown). On the other hand, the grinding wheel 33 of the rough grinding unit 3 is subjected to grinding feed, and lowered by a predetermined amount, by the grinding feeding mechanism 38 while being rotated in a predetermined direction. As a result, the back-side surface 15*b* of the semiconductor wafer 15 on the chuck table 6 undergoes rough grinding (rough grinding step). Incidentally, during this step, a semiconductor wafer 15 yet to be ground is mounted onto the next chuck table 6 positioned in the work feeding-in/feeding-out region A, as above-mentioned. Then, the semiconductor wafer 15 is suction held onto the chuck table 6 by operating the suction means (not shown). Subsequently, the turntable 5 is rotated by 120 degrees in the direction of arrow 5*a*, whereby the chuck table 6 holding thereon the semiconductor wafer 15 having undergone rough grinding is positioned into the finish grinding region C, while the chuck table 6 holding thereon the semiconductor wafer 15 yet to be ground is positioned into the rough grinding region B.

In this manner, the back-side surface 15*b* of the semiconductor wafer 15 yet to be rough ground which is held on the chuck table 6 positioned in the rough grinding region B is subjected to rough grinding by the rough grinding unit 3, while the back-side surface 15*b* of the semiconductor wafer 15 which is mounted on the chuck table 6 positioned in the finish grinding region C and which has undergone rough grinding is subjected to finish grinding by the finish grinding unit 5 (finish grinding step). Next, the turntable 5 is rotated by 120 degrees in the direction of arrow 5*a*, whereby the chuck table 6 holding thereon the semiconductor wafer 15 having undergone finish grinding is positioned into the work feeding-in/feeding-out region A. Incidentally, the chuck table 6 holding thereon the semiconductor wafer 15 having undergone rough grinding in the rough grinding region B is moved into the finish grinding region C, while the chuck table 6 holding the semiconductor wafer 15 yet to be ground thereon and being in the work feeding-in/feeding-out region A is moved into the rough grinding region B.

Incidentally, in the chuck table 6 returned into the work feeding-in/feeding-out region A after being passed through the rough grinding region B and the finish grinding region C, the suction holding of the finish-ground semiconductor wafer 15 is released there. Then, the finish-ground semiconductor wafer 15 on the chuck table 6 positioned in the work feeding-in/feeding-out region A is fed out to the spinner cleaning means 11 by the work feeding-out means 14. The semiconductor wafer 15 fed to the spinner cleaning means 11 is subjected there to cleaning so as to remove the grinding chips adhering to the back-side surface 15*b* (ground surface) and side surface thereof, and is spin dried. The semiconductor wafer 15 thus cleaned and spin dried is fed to and stored into the second cassette 8 by the work feeding means 12.

Now, the first-named invention of the method of grinding a wafer which includes the rough grinding step and the finish grinding step will be described below. The rough grinding step in the first-named invention is carried out in the condition where the grinding surface of the rough grinding wheel is positioned at a predetermined inclination angle relative to the holding surface of the chuck table. A first embodiment of the rough grinding step in the first-named invention will be described referring to FIGS. 5A and 5B.

Figure 5A:
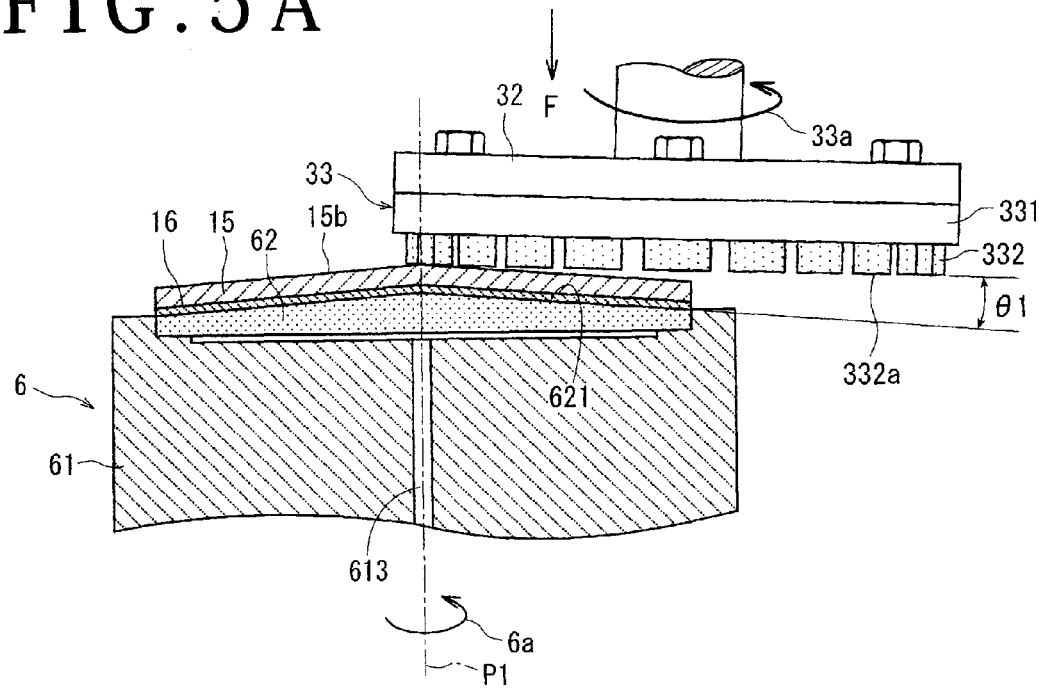
FIGS. 5A and 5B illustrate a first embodiment of the rough grinding step in the first-named invention of the method of grinding a wafer according to the present invention.
Figure 5B:
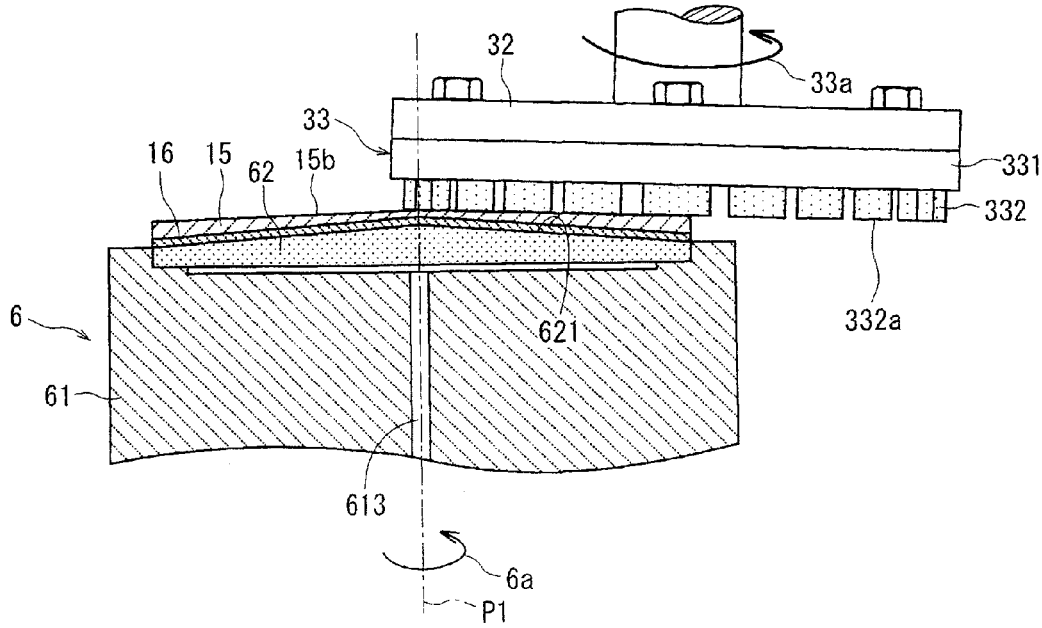

The first embodiment of the rough grinding step in the first-named invention is carried out as follows. As shown in FIG. 5A, the grinding surface 332*a* of the rough grinding stones 332 constituting the rough grinding wheel 33 is positioned at a predetermined inclination angle (θ1) relative to the holding surface 621 of the suction holding chuck 62 constituting the chuck table 6. The inclination angle (θ1) is preferably set in the range of 0.01 to 0.03 milliradian. In the first embodiment shown in FIGS. 5A and 5B, the grinding surface 332*a* of the rough grinding stones 332 constituting the rough grinding wheel 33 is positioned in the state of being so inclined as to be contacted first by a central portion of the back-side surface 15*b* (the surface to be ground) of the semiconductor wafer 15 held on the holding surface 621 of the suction holding chuck 62 constituting the chuck table 6. Incidentally, the grinding surface 332*a* of the rough grinding stones 332 constituting the rough grinding wheel 33 is positioned at a predetermined inclination angle (θ1) relative to the holding surface 621 of the suction holding chuck 62 constituting the chuck table 6, by use of the above-mentioned angle adjusting means 37. Starting from the condition shown in FIG. 5A, the chuck table 6 is rotated in the direction of arrow 6*a*, and the rough grinding wheel 33 is put into grinding feed in the direction of arrow F while being rotated in the direction of arrow 33*a*. As a result, the back-side surface 15*b* (the surface to be ground) of the semiconductor wafer 15 held on the holding surface 621 of the suction holding chuck 62 constituting the chuck table 6 is ground correspondingly to the inclination of the grinding surface 332*a* of the rough grinding stones 332 constituting the rough grinding wheel 33, as shown in FIG. 5B. The semiconductor wafer 15 ground in this manner has a form in which its thickness gradually increases along the direction from its center toward its outer periphery.

Figure 6A:
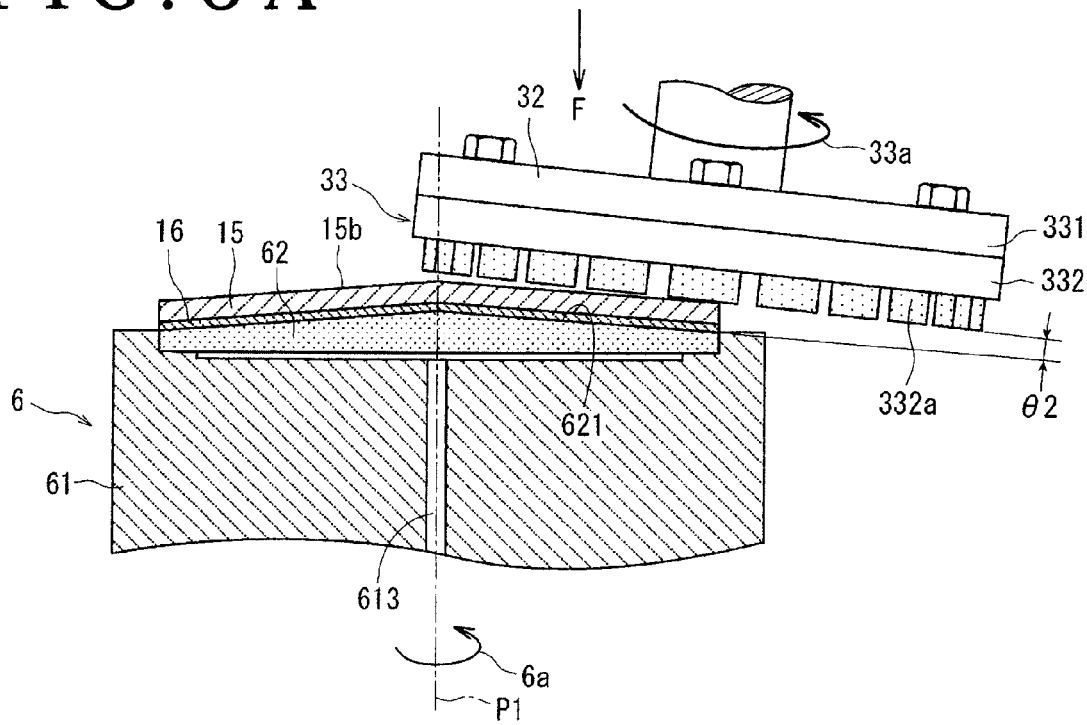
FIGS. 6A and 6B illustrate a second embodiment of the rough grinding step in the first-named invention of the method of grinding a wafer according to the present invention.
Figure 6B:
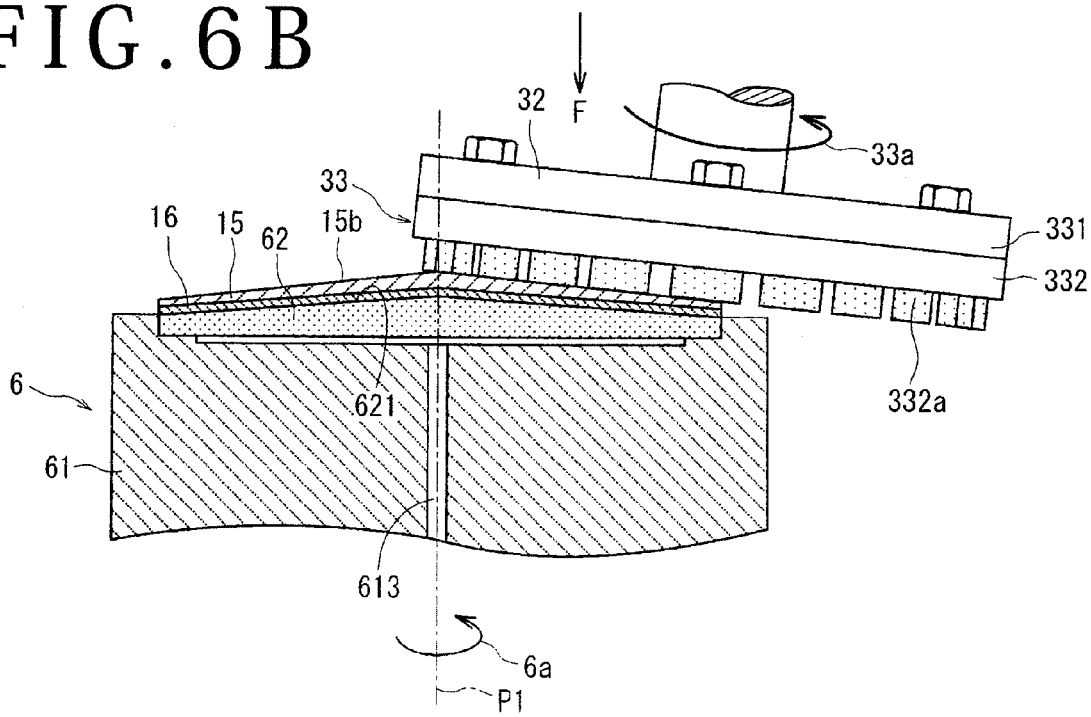

Now, a second embodiment of the rough grinding step in the first-named invention will be described referring to FIGS. 6A and 6B. The second embodiment of the rough grinding step in the first-named invention is carried out as follows. As shown in FIG. 6A, the grinding surface 332*a* of the rough grinding stones 332 constituting the rough grinding wheel 33 is positioned at a predetermined inclination angle (θ2) relative to the holding surface 621 of the suction holding chuck 62 constituting the chuck table 6. The inclination angle (θ2) is preferably set in the range of 0.01 to 0.03 milliradian. In the second embodiment shown in FIGS. 6A and 6B, the grinding surface 332*a* of the rough grinding stones 332 constituting the rough grinding wheel 33 is so positioned in the state of being so inclined as to be contacted first by an outer peripheral portion of the back-side surface 15*b* (the surface to be ground) of the semiconductor wafer 15 held on the holding surface 621 of the suction holding chuck 62 constituting the chuck table 6. Incidentally, the grinding surface 332*a* of the rough grinding stones 332 constituting the rough grinding wheel 33 is positioned at the predetermined inclination angle (θ2) relative to the holding surface 621 of the suction holding chuck 62 constituting the chuck table 6, by use of the above-mentioned angle adjusting means 37. Starting from the condition shown in FIG. 6A, the chuck table 6 is rotated in the direction of arrow 6*a*, and the rough grinding wheel 33 is put into grinding feed in the direction of arrow F while being rotated in the direction of arrow 33*a*. As a result, the back-side surface 15*b* (the surface to be ground) of the semiconductor wafer 15 held on the holding surface 621 of the suction holding chuck 62 constituting the chuck table 6 is ground correspondingly to the inclination of the grinding surface 332*a* of the rough grinding stones 332 constituting the rough grinding wheel 33, as shown in FIG. 6B. The semiconductor wafer 15 thus ground has a form in which its thickness gradually increases along the direction from its outer periphery toward its center.

After the rough grinding step in the first-named invention is carried out as above-described, the turntable 5 is rotated by 120 degrees in the direction of arrow 5*a* in FIG. 1, whereby the chuck table 6 holding the semiconductor wafer 15 having undergone rough grinding is positioned in the finish grinding region C, and the finish grinding step is conducted. The finish grinding step is carried out as follows. The grinding surface of the finish grinding wheel is positioned in parallel to the holding surface of the chuck table, and the finish grinding wheel is rotated in the grinding region of the finish grinding wheel in the direction toward the vertex of the contact angle between the grinding surface of the finish grinding wheel and the surface to be ground of the wafer. A first embodiment of the finish grinding step in the first-named invention will be described referring to FIGS. 7A to 7C.

Figure 7A:
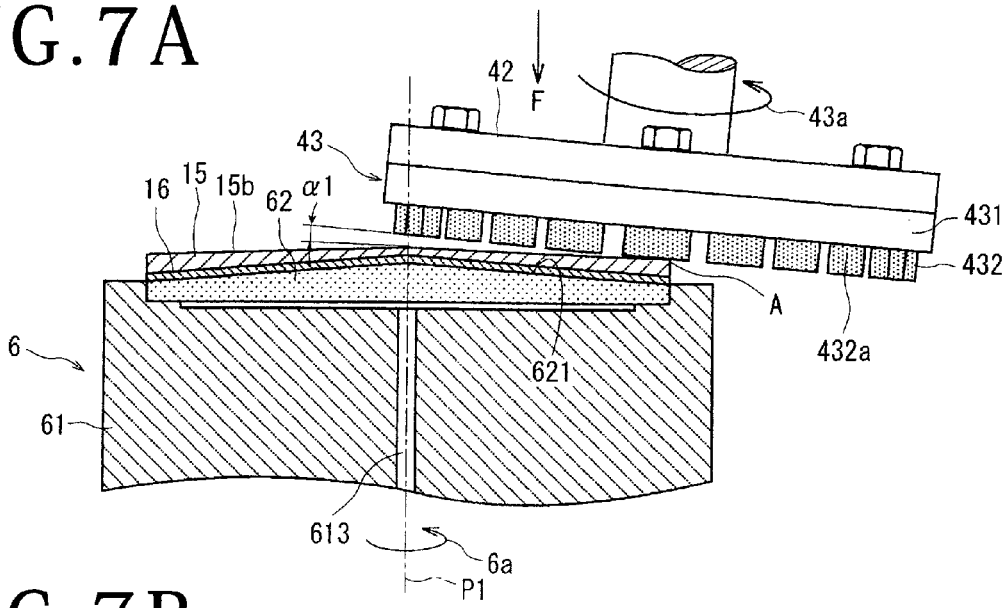
FIGS. 7A to 7C illustrate a first embodiment of the finish grinding step in the first-named invention of the method of grinding a wafer according to the present invention.
Figure 7B:
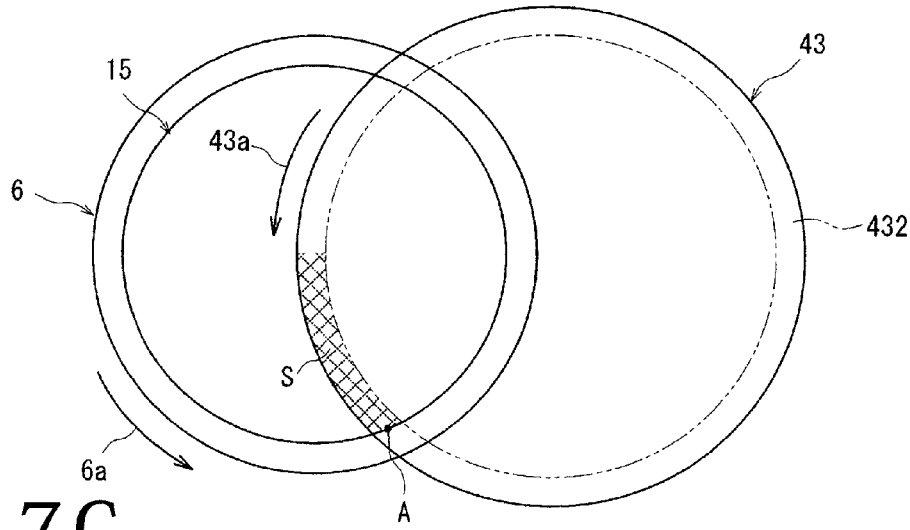

The first embodiment of the finish grinding step in the first-named invention is applied to the semiconductor wafer 15 having undergone the rough grinding by the first embodiment of the rough grinding step in the first-named invention shown in FIGS. 5A and 5B. Specifically, as shown in FIG. 7A, the grinding surface 432*a* of the finish grinding stones 432 constituting the finish grinding wheel 43 is positioned in parallel to the holding surface 621 of the suction holding chuck 62 constituting the chuck table 6. Therefore, in the first embodiment shown in FIGS. 7A and 7B, the grinding surface 432*a* of the finish grinding stones 432 constituting the finish grinding wheel 43 first comes into contact with an outer peripheral portion of the back-side surface 15*b* (the surface to be ground) of the semiconductor wafer 15 held on the holding surface 621 of the suction holding chuck 62 constituting the chuck table 6. Incidentally, the grinding surface 432*a* of the finish grinding stones 432 constituting the finish grinding wheel 43 is positioned in parallel to the holding surface 621 of the suction holding chuck 62 constituting the chuck table 6, by the above-mentioned angle adjusting means 47.

Starting from the condition shown in FIG. 7A, the chuck table 6 is rotated in the direction of arrow 6*a*, and the finish grinding wheel 43 is put into grinding feed in the direction of arrow F while being rotated in the direction of arrow 43*a*, as shown in FIG. 7A. Here, the rotating direction of the finish grinding wheel 43 will be described. When the grinding surface 432*a* of the finish grinding stones 432 constituting the finish grinding wheel 43 is positioned in parallel to the holding surface 621 of the suction holding chuck 62 constituting the chuck table 6 as shown in FIG. 7A, the grinding surface 432*a* of the finish grinding stones 432 comes into contact with the back-side surface 15*b* (the surface to be ground) of the semiconductor wafer 15 held on the holding surface 621 of the suction holding chuck 62 constituting the chuck table 6, at a predetermined contact angle ($\alpha$1, which is 0.01 to 0.03 milliradian when $\theta$1 is 0.01 to 0.03 milliradian). In addition, since the holding surface 621 of the suction holding chuck 62 constituting the chuck table 6 is formed in a conical shape, the grinding region S of the finish grinding stones 432 constituting the finish grinding wheel 43 in relation to the back-side surface 15*b* (the surface to be ground) of the semiconductor wafer 15 is the hatched region in FIG. 7B.

Figure 7C:
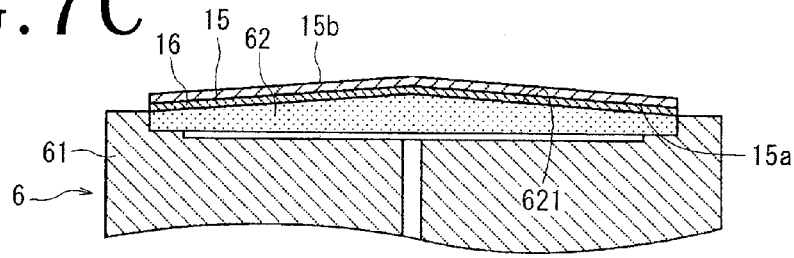

It is important that the rotating direction 43*a* in the process in which the finish grinding stones 432 constituting the finish grinding wheel 43 thus pass through the grinding region S is set in the direction toward the vertex A of the contact angle ($\alpha$1). With the rotating direction of the finish grinding wheel 43 set in this manner, the so-called bite into the back-side surface 15*b* (the surface to be ground) of the semiconductor wafer 15 is good, and surface burning can be prevented from occurring, even when the grain diameter of the finish grinding stones 432 constituting the finish grinding wheel 43 is minute. With the finish grinding step carried out as above, the semiconductor wafer 15 is ground in parallel to the holding surface 621 of the suction holding chuck 62 constituting the chuck table 6, as shown in FIG. 7C. Accordingly, the semiconductor wafer 15 is formed to have a predetermined thickness, with the back-side surface 15*b* (the surface to be ground) thereof made parallel to the face-side surface 15*a* thereof.

Figure 8A:
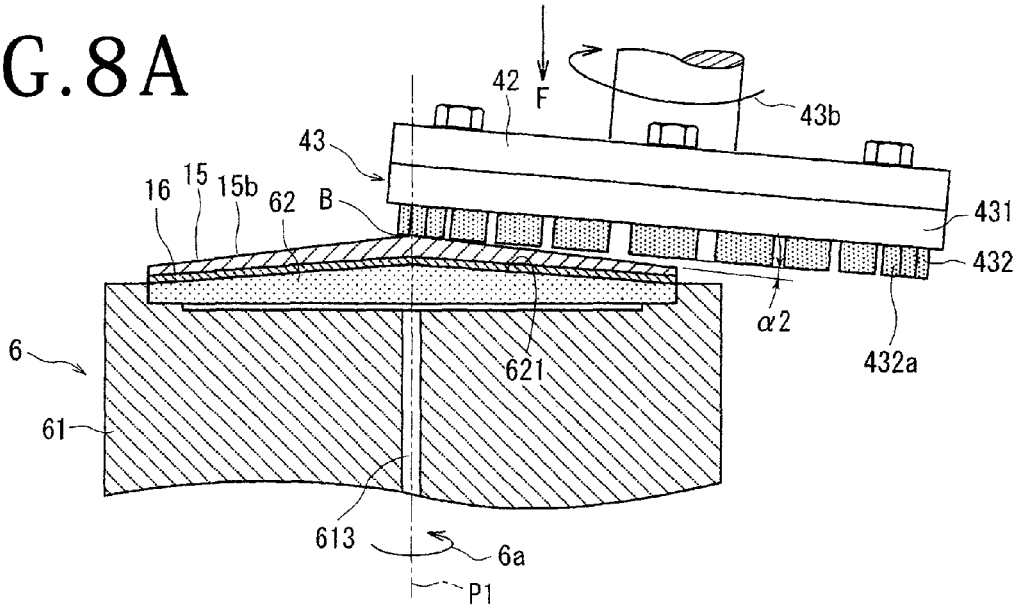
FIGS. 8A to 8C illustrate a second embodiment of the finish grinding step in the first-named invention of the method of grinding a wafer according to the present invention.
Figure 8B:
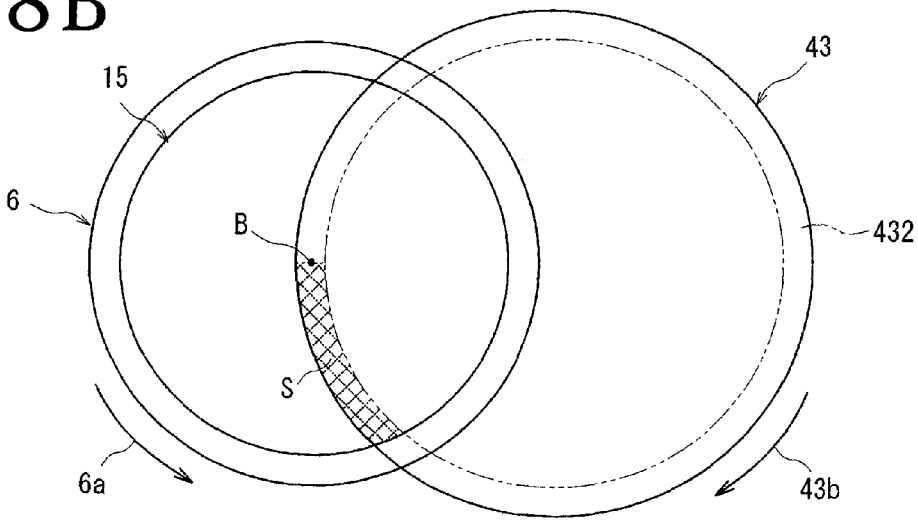

Now, a second embodiment of the finish grinding step in the first-named invention will be described below, referring to FIGS. 8A and 8B. The second embodiment of the finish grinding step in the first-named invention is applied to the semiconductor wafer 15 having undergone the rough grinding by the second embodiment of the rough grinding step in the first-named invention shown in FIGS. 6A and 6B. Specifically, as shown in FIG. 8A, the grinding surface 432*a* of the finish grinding stones 432 constituting the finish grinding wheel 43 is positioned in parallel to the holding surface 621 of the suction holding chuck 62 constituting the chuck table 6. Therefore, in the second embodiment shown in FIGS. 8A and 8B, the grinding surface 432*a* of the finish grinding stones 432 constituting the finish grinding wheel 43 first comes into contact with a central portion of the back-side surface 15*b* (the surface to be ground) of the semiconductor wafer 15 held on the holding surface 621 of the suction holding chuck 62 constituting the chuck table 6. Incidentally, the grinding surface 432*a* of the finish grinding stones 432 constituting the finish grinding wheel 43 is positioned in parallel to the holding surface 621 of the suction holding chuck 62 constituting the chuck table 6, by use of the above-mentioned angle adjusting means 47.

Starting from the condition shown in FIG. 8A, the chuck table 6 is rotated in the direction of arrow 6*a*, and the finish grinding wheel 43 is put into grinding feed in the direction of arrow F while being rotated in the direction of arrow 43*b*, as shown in FIG. 8A. Here, the rotating direction of the finish grinding wheel 43 will be described. When the grinding surface 432*a* of the finish grinding stones 432 constituting the finish grinding wheel 43 is positioned in parallel to the holding surface 621 of the suction holding chuck 62 constituting the chuck table 6, as shown in FIG. 8A, the grinding surface 432*a* of the finish grinding stones 432 constituting the finish grinding wheel 43 makes contact with the back-side surface 15*b* (the surface to be ground) of the semiconductor wafer 15 held on the holding surface 621 of the suction holding chuck 62 constituting the chuck table 6, at a predetermined contact angle ($\alpha$2, which is 0.01 to 0.03 milliradian when $\theta$2 is 0.01 to 0.03 milliradian). In addition, since the holding surface 621 of the suction holding chuck 62 constituting the chuck table 6 is formed in a conical shape, the grinding region S of the finish grinding stones 432 constituting the grinding wheel 43 in relation to the back-side surface 15*b* (the surface to be ground) of the semiconductor wafer 15 is the hatched region in FIG. 8B.

Figure 8C:
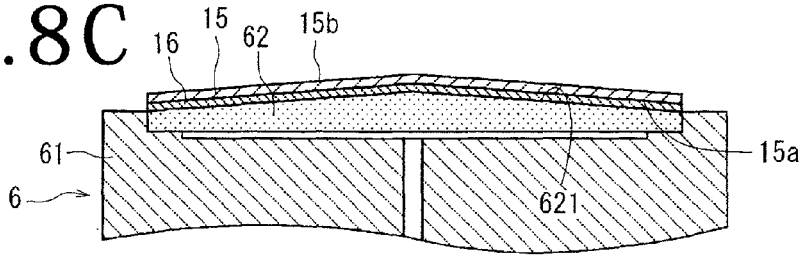

It is important that the rotating direction 43*a* in the process in which the finish grinding stones 432 constituting the grinding wheel 43 thus pass through the grinding region S is set in the direction toward the vertex B of the contact angle ($\alpha$2). With the rotating direction of the grinding wheel 43 set in this manner, the so-called bite into the back-side surface 15*b* (the surface to be ground) of the semiconductor wafer 15 is made to be good, and surface burning can be prevented from occurring, even when the grain diameter of the abrasive grains of the finish grinding stones 432 constituting the grinding wheel 43 is minute. With the finish grinding step carried out in the above-mentioned manner, the semiconductor wafer 15 is ground in parallel to the holding surface 621 of the suction holding chuck 62 constituting the chuck table 6, as shown in FIG. 8C. Accordingly, the semiconductor wafer 15 is formed to have a predetermined thickness, with its back-side surface 15*b* (the surface to be ground) and its face-side surface 15*a* made parallel to each other.

Figure 9A:
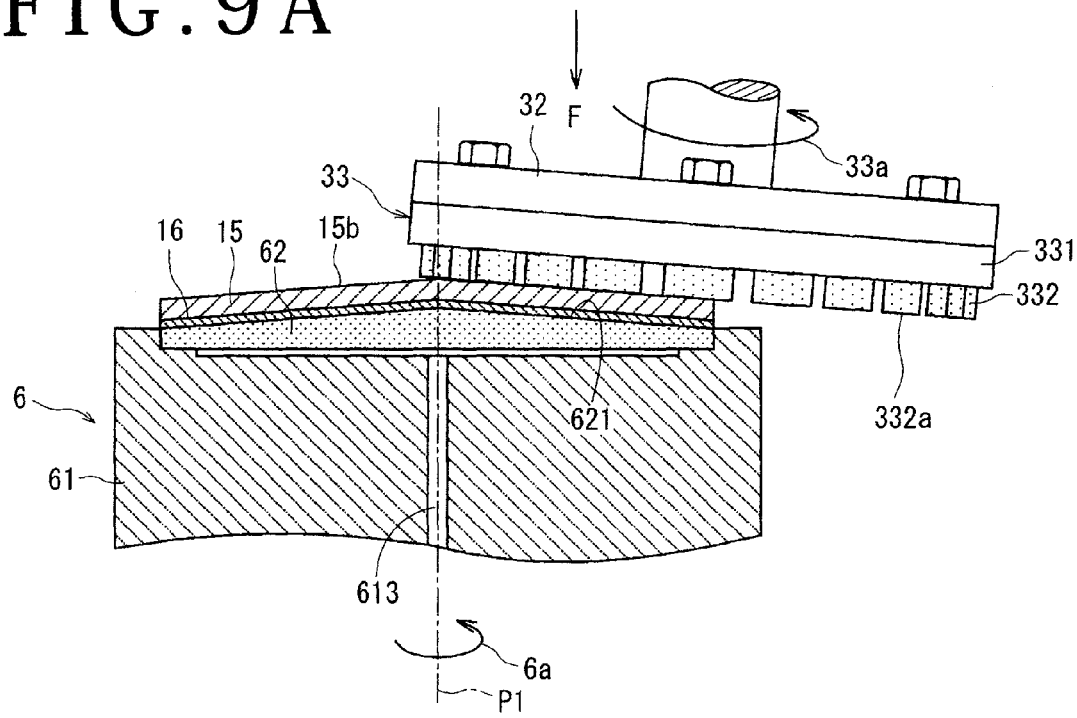
FIGS. 9A to 9B illustrate the rough grinding step in a second-named invention of the method of grinding a wafer according to the present invention.
Figure 9B:
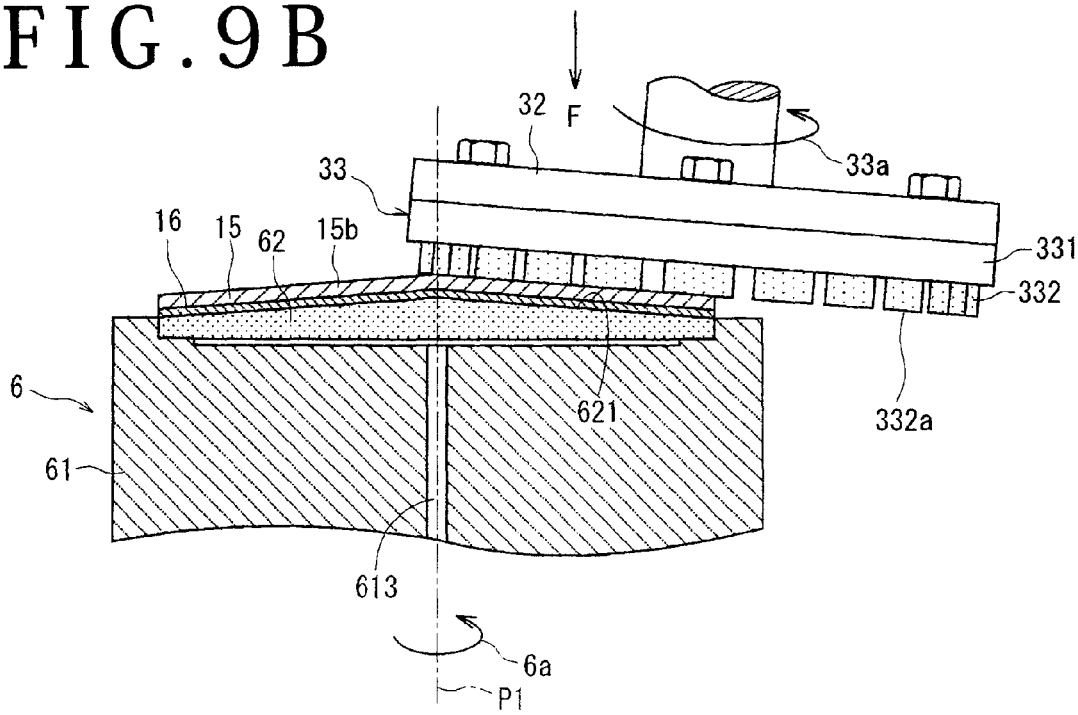

Now, a second-named invention of the method of grinding a wafer according to the present invention will be described below. The rough grinding step in the second-named invention is carried out by positioning the grinding surface of the rough grinding wheel in parallel to the holding surface of the chuck table. The rough grinding step in the second-named invention will be described referring to FIGS. 9A and 9B. In the rough grinding step in the second-named invention of the method of grinding a wafer according to the present invention, as shown in FIG. 9A, the grinding surface 332*a* of the rough grinding stones 332 constituting the rough grinding wheel 33 is positioned in parallel to the holding surface 621 of the suction holding chuck 62 constituting the chuck table 6. Incidentally, the grinding surface 332*a* of the rough grinding stones 332 constituting the rough grinding wheel 33 is positioned in parallel to the holding surface 621 of the suction holding chuck 62 constituting the chuck table 6, by use of the above-mentioned angle adjusting means 47. Starting from the condition shown in FIG. 9A, the chuck table 6 is rotated in the direction of arrow 6*a*, and the rough grinding wheel 33 is put into grinding feed in the direction of arrow F while being rotated in the direction of arrow 33*a*. As a result, the back-side surface 15*b* (the surface to be ground) of the semiconductor wafer 15 held on the holding surface 621 of the suction holding chuck 62 constituting the chuck table 6 is rough ground in parallel to the holding surface 621 of the suction holding chuck 62 constituting the chuck table 6, as shown in FIG. 9B.

After the rough grinding step in the second-named invention is carried out as above, the turntable 5 is turned by 120 degrees in the direction of arrow 5*a* in FIG. 1, whereby the chuck table 6 holding thereon the semiconductor wafer 15 having undergone the rough grinding is positioned into the finish grinding region C, and a finish grinding step is carried out. The finish grinding step is carried out as follows. The grinding surface of the finish grinding wheel is positioned at a predetermined inclination angle relative to the holding surface of the chuck table, and the finish grinding wheel is rotated in the grinding region of the finish grinding wheel in the direction toward the vertex of the contact angle between the grinding surface of the finish grinding wheel and the surface to be ground of the wafer. A first embodiment of the finish grinding step in the second-named invention will be described referring to FIGS. 10A and 10B.

Figure 10A:
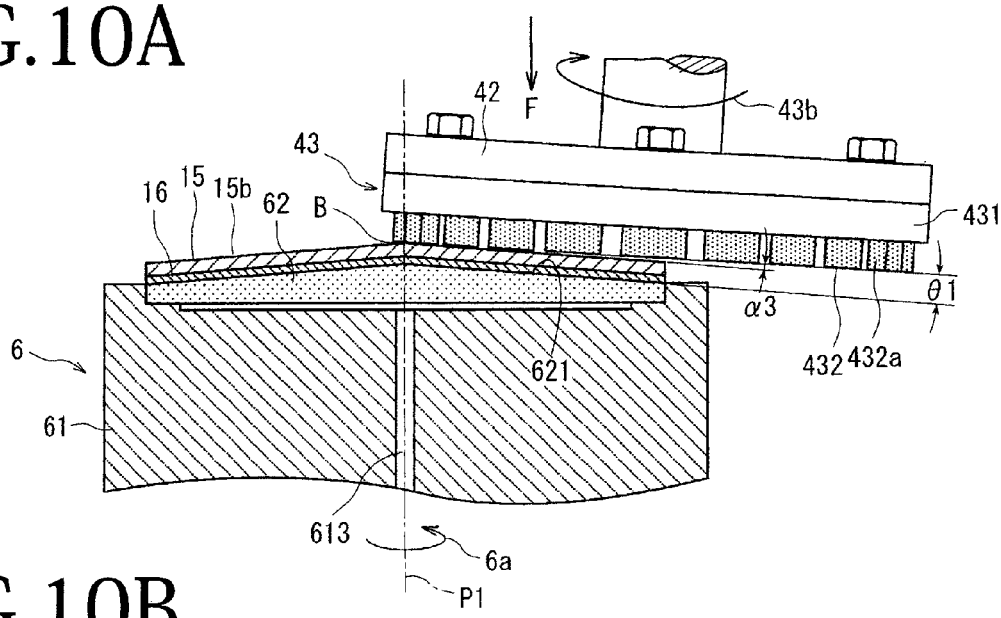
FIGS. 10A to 10C illustrate a first embodiment of the finish grinding step in the second-named invention of the method of grinding a wafer according to the present invention.
Figure 10B:
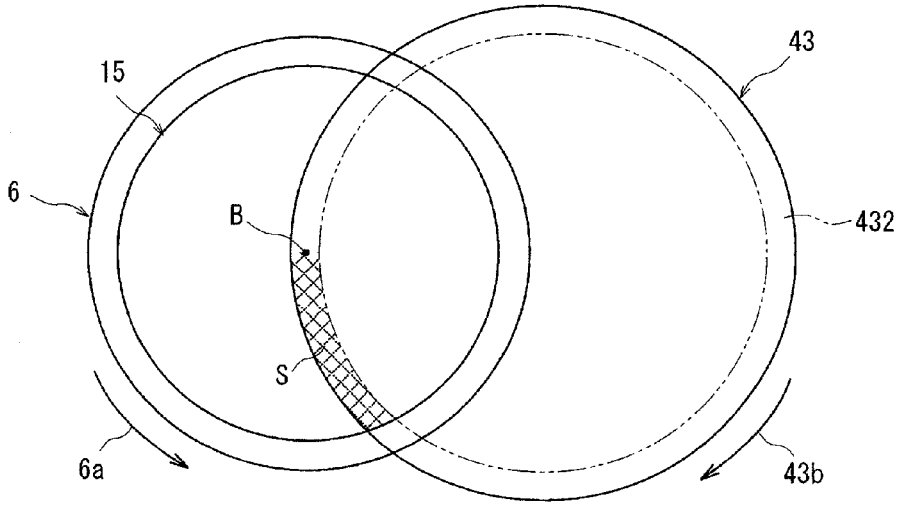

The first embodiment of the finish grinding step in the second-named invention is carried out as follows. As shown in FIG. 10A, the grinding surface 432*a* of the finish grinding stones 432 constituting the finish grinding wheel 43 is positioned at a predetermined inclination angle (θ1) relative to the holding surface 621 of the suction holding chuck 62 constituting the chuck table 6. The inclination angle (θ1) is preferably set in the range of 0.01 to 0.03 milliradian. In the first embodiment shown in FIGS. 10A and 10B, the grinding surface 432*a* of the finish grinding stones 432 constituting the grinding wheel 43 is positioned in the state of being so inclined as to first make contact with a central portion of the back-side surface 15*b* (the surface to be ground) of the semiconductor wafer 15 held on the holding surface 621 of the suction holding chuck 62 constituting the chuck table 6. Incidentally, the grinding surface 432*a* of the finish grinding stones 432 constituting the finish grinding wheel 43 is positioned at the predetermined inclination angle (θ1) relative to the holding surface 621 of the suction holding chuck 62 constituting the chuck table 6, by use of the above-mentioned angle adjusting means 47.

Starting from the condition shown in FIG. 10A, the chuck table 6 is rotated in the direction of arrow 6*a*, and the finish grinding wheel 43 is put into grinding feed in the direction of arrow F while being rotated in the direction of arrow 43*b*. Here, the rotating direction of the finish grinding wheel 43 will be described. When the grinding surface 432*a* of the finish grinding stones 432 constituting the finish grinding wheel 43 is positioned at the predetermined inclination angle (θ1) relative to the holding surface 621 of the suction holding chuck 62 constituting the chuck table 6 as shown in FIG. 10A, the grinding surface 432*a* of the finish grinding stones 432 constituting the finish grinding wheel 43 makes contact with the back-side surface 15*b* (the surface to be ground) of the semiconductor wafer 15 held on the holding surface 621 of the suction holding chuck 62 constituting the chuck table 6, at a predetermined contact angle (α3, which is 0.01 to 0.03 milliradian when θ1 is 0.01 to 0.03 milliradian). In addition, since the holding surface 621 of the suction holding chuck 62 constituting the chuck table 6 is formed in a conical shape, the grinding region S of the finish grinding stones 432 constituting the finish grinding wheel 43 in relation to the back-side surface 15*b* (the surface to be ground) of the semiconductor wafer 15 is the hatched region in FIG. 10B.

Figure 10C:
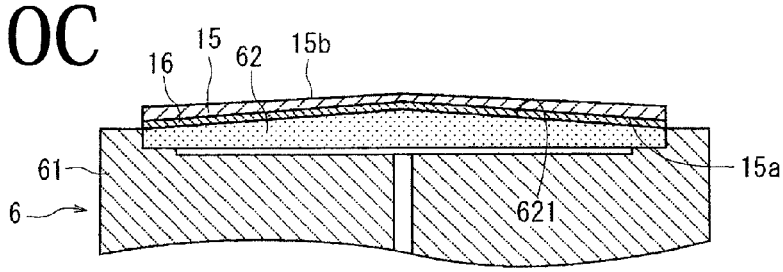

It is important that the rotating direction 33*b* in the process in which the finish grinding stones 432 constituting the finish grinding wheel 43 thus pass through the grinding region S is set in the direction toward the vertex B of the contact angle (α3). With the rotating direction of the finish grinding wheel 43 set in this manner, the so-called bite into the back-side surface 15*b* (the surface to be ground) of the semiconductor wafer 15 is made to be good, and surface burning can be prevented from occurring, even when the grain diameter of the abrasive grains of the finish grinding stones 432 constituting the finish grinding wheel 43 is minute. With the finish grinding step carried out in the above-mentioned manner, the semiconductor wafer 15 is formed to have a thickness which gradually increases along the direction from its center toward its outer periphery, as shown in FIG. 10C.

Figure 11A:
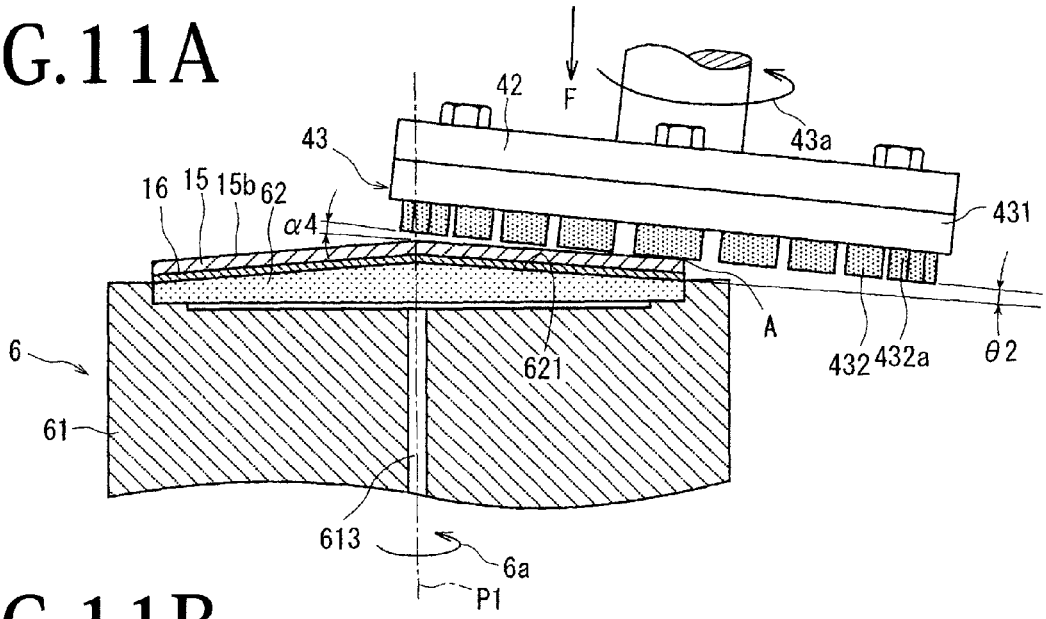
FIGS. 11A to 11C illustrate a second embodiment of the finish grinding step in the second-named invention of the method of grinding a wafer according to the present invention.
Figure 11B:
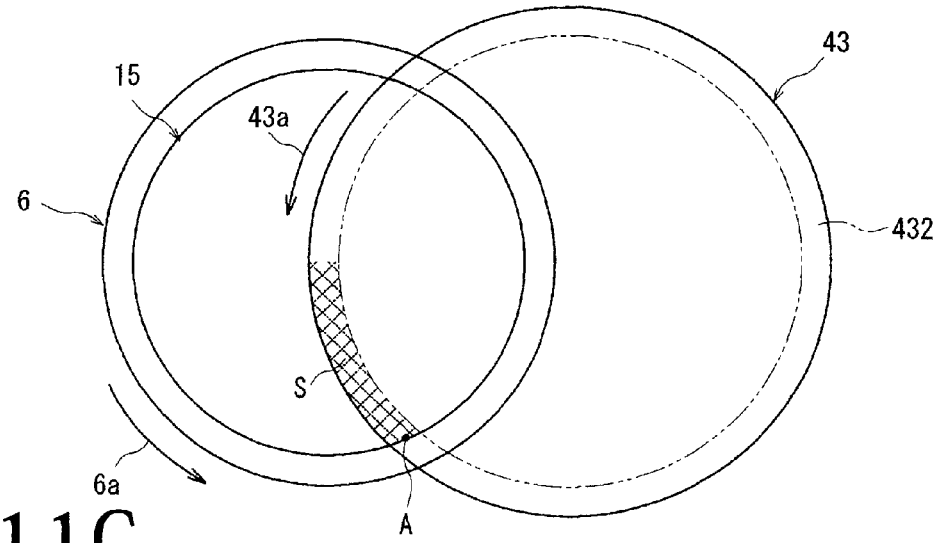

Now, a second embodiment of the finish grinding step in the second-named invention will be described referring to FIGS. 11A and 11B. The second embodiment of the finish grinding step in the second-named invention is carried out as follows. As shown in FIG. 11A, the grinding surface 432*a* of the finish grinding stones 432 constituting the finish grinding wheel 43 is positioned at a predetermined inclination angle (θ2) relative to the holding surface 621 of the suction holding chuck 62 constituting the chuck table 6. The inclination angle (θ2) is preferably set in the range of 0.01 to 0.03 milliradian. In the first embodiment shown in FIGS. 11A and 11B, the grinding surface 432*a* of the finish grinding stones 432 constituting the finish grinding wheel 43 is positioned in the state of being so inclined as to first make contact with an outer peripheral portion of the back-side surface 15*b* (the surface to be ground) of the semiconductor wafer 15 held on the holding surface 621 of the suction holding chuck 62 constituting the chuck table 6. Incidentally, the grinding surface 432*a* of the finish grinding stones 432 constituting the finish grinding wheel 43 is positioned at the predetermined inclination angle (θ2) relative to the holding surface 621 of the suction holding chuck 62 constituting the chuck table 6, by use of the above-mentioned angle adjusting means 47.

Starting from the condition shown in FIG. 11A, the chuck table 6 is rotated in the direction of arrow 6*a*, and the finish grinding wheel 43 is put into grinding feed in the direction of arrow F while being rotated in the direction of arrow 43*a*. Here, the rotating direction of the finish grinding wheel 43 will be described. As shown in FIG. 11A, when the grinding surface 432*a* of the finish grinding stones 432 constituting the finish grinding wheel 43 is positioned at the predetermined inclination angle (θ2) relative to the holding surface 621 of the suction holding chuck 62 constituting the chuck table 6, the grinding surface 432*a* of the finish grinding stones 432 constituting the finish grinding wheel 43 makes contact with the back-side surface 15*b* (the surface to be ground) of the semiconductor wafer 15 held on the holding surface 621 of the suction holding chuck 62 constituting the chuck table 6, at a predetermined contact angle (α4, which is 0.01 to 0.03 milliradian when θ2 is 0.01 to 0.03 milliradian). Besides, since the holding surface 621 of the suction holding chuck 62 constituting the chuck table 6 is formed in a conical shape, as shown in FIG. 11B, the grinding region S of the finish grinding stones 432 constituting the finish grinding wheel 43 in relation to the back-side surface 15*b* (the surface to be ground) of the semiconductor wafer 15 is the hatched region in FIG. 11B.

Figure 11C:
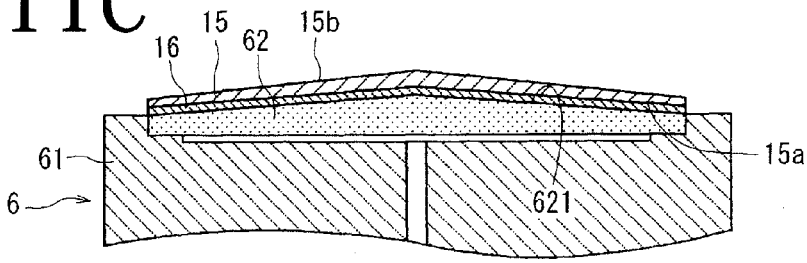

It is important that the rotating direction 43*a* in the process in which the finish grinding stones 432 constituting the finish grinding wheel 43 thus pass through the grinding region S is set in the direction toward the vertex A of the contact angle (α4). With the rotating direction of the finish grinding wheel 43 set in this manner, the so-called bite into the back-side surface 15*b* (the surface to be ground) of the semiconductor wafer 15 is made to be good, and surface burning can be prevented from occurring, even when the grain diameter of the abrasive grains of the finish grinding stones 432 constituting the finish grinding wheel 43 is minute. With the finish grinding step carried out as above, the semiconductor wafer 15 is formed to have a thickness which gradually increases along the direction from its outer periphery toward its center, as shown in FIG. 11C.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A method of grinding a wafer, comprising:

a wafer holding step for holding a wafer on a conical holding surface of a chuck table having said holding surface;

a rough grinding step for performing rough grinding of the wafer held on said holding surface of said chuck table, by positioning a grinding surface of a rough grinding wheel at a predetermined inclination angle relative to said holding surface of said chuck table and rotating said rough grinding wheel; and a finish grinding step for performing finish grinding of the wafer by positioning a grinding surface of a finish grinding wheel in parallel to said holding surface of said chuck table, and rotating said finish grinding wheel in a grinding region of said finish grinding wheel in a direction toward the vertex of a contact angle between said grinding surface of said finish grinding wheel and a surface to be ground of the wafer.

2. The method of grinding a wafer, as set forth in claim 1, wherein said inclination angle of said grinding surface of said rough grinding wheel relative to said holding surface of said chuck table is set in the range of 0.01 to 0.03 milliradian.

3. A method of grinding a wafer, comprising:

a wafer holding step for holding a wafer on a conical holding surface of a chuck table having said holding surface;

a rough grinding step for performing rough grinding of the wafer held on said holding surface of said chuck table, by positioning a grinding surface of a rough grinding wheel in parallel to said holding surface of said chuck table and rotating said rough grinding wheel; and a finish grinding step for performing finish grinding of the wafer by positioning a grinding surface of a finish grinding wheel at a predetermined inclination angle relative to said holding surface of said chuck table, and rotating said finish grinding wheel in a grinding region of said finish grinding wheel in a direction toward a vertex of a contact angle between said grinding surface of said finish grinding wheel and a surface to be ground of the wafer.

4. The method of grinding a wafer, as set forth in claim 3, wherein said inclination angle of said grinding surface of said finish grinding wheel relative to said holding surface of said chuck table is set in the range of 0.01 to 0.03 milliradian.

* * * * *